US005791921A

United States Patent [19]

Lee

[11] Patent Number: 5,791,921

[45] Date of Patent: Aug. 11, 1998

[54] EASILY OPERABLE UNIVERSAL ADAPTER

[76] Inventor: Anthony Lee, c/o Hung Hsing Patent Service Center, P.O. Box 55-1670, Taipei, Taiwan

[21] Appl. No.: 780,794

[22] Filed: Jan. 9, 1997

[51] Int. Cl.[6] ..... H01R 29/00

[52] U.S. Cl. ..... 439/172; 439/103; 439/651

[58] Field of Search ..... 439/131, 169–173, 439/103, 651, 652

[56] References Cited

U.S. PATENT DOCUMENTS

| | | | |
|---|---|---|---|
| 3,079,475 | 2/1963 | Rumble | 439/172 |
| 4,856,999 | 8/1989 | Flohr | 439/171 |
| 5,159,545 | 10/1992 | Lee | 439/103 |
| 5,474,464 | 12/1995 | Drewmicher | 439/172 |
| 5,611,701 | 3/1997 | Haln | 439/172 |

*Primary Examiner*—Hien Vu

[57] ABSTRACT

A universal adapter includes: a casing combinable with a front cover and a rear cover having a pair of outlet sockets formed in the rear cover to output power, a first plug having a pair of rectangular-shaped pins slidably held in an upper chamber in the casing and operatively pushed or pulled by a pair of first seesaw buttons pivotally secured on two opposite sides of the first plug for a convenient extending or retraction of the first plug, whereby upon extending of the first plug, a rectangular-shaped pin of "grounding pin" will be simultaneously biased for its forward extending to form triple rectangular-shaped pins for connecting municipal power such as in England or Africa to be output through the pair of outlet sockets in the rear cover; a second plug having a pair of flat blades slidably held in a lower chamber in the casing and operatively pushed or pulled by a pair of second seesaw buttons for a convenient extension or retraction for connecting municipal power to the two outlet sockets; and a third plug having a pair of round pins pivotally mounted on the front cover to be horizontally extended for power connection use and vertically received into the front cover when not in use.

7 Claims, 6 Drawing Sheets

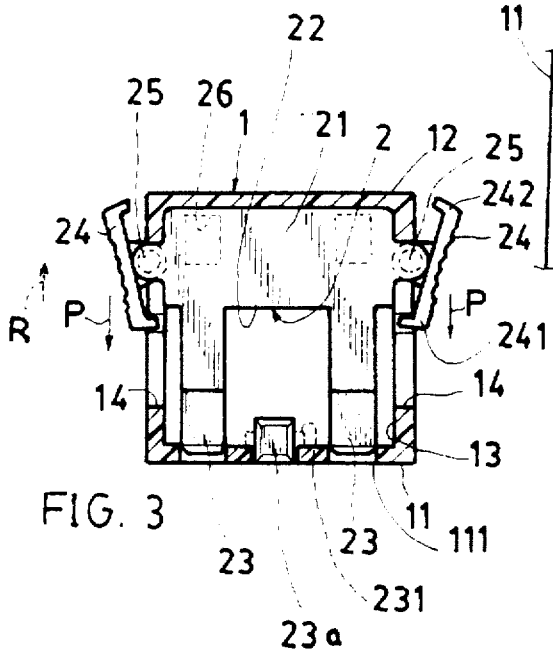
FIG. 3
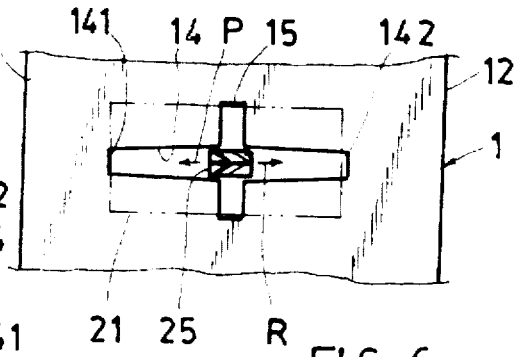
FIG. 6
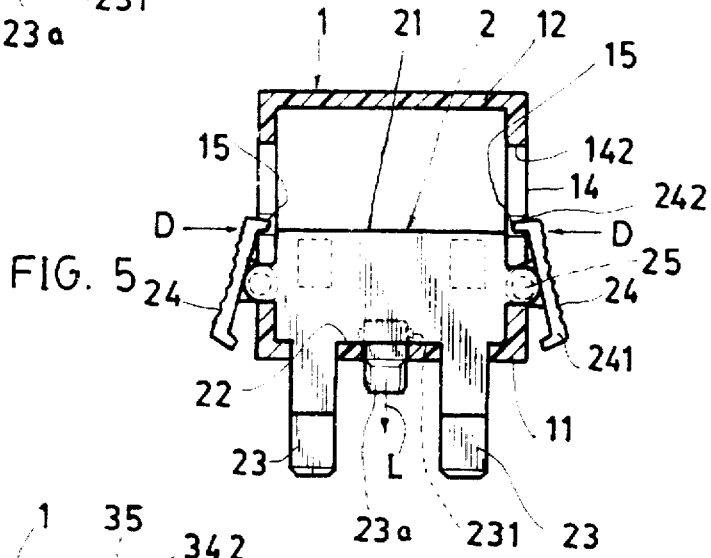
FIG. 5
FIG. 8
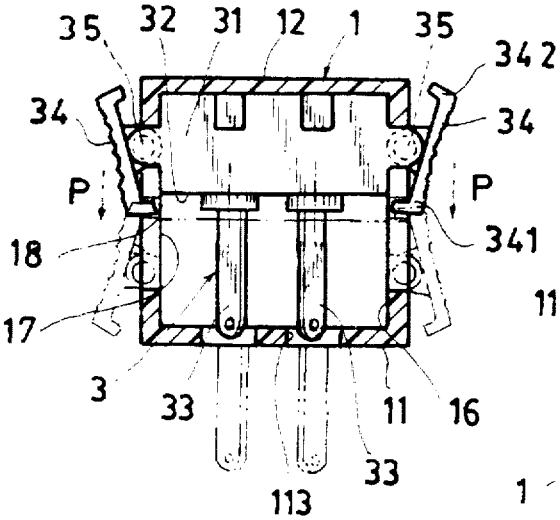
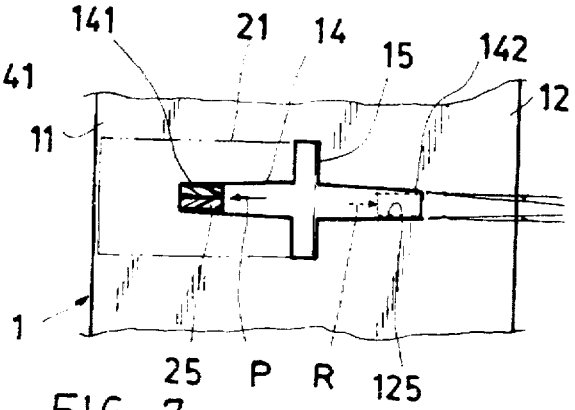
FIG. 7

EASILY OPERABLE UNIVERSAL ADAPTER

BACKGROUND OF THE INVENTION

U.S. Pat. No. 5,159,545 entitled "Universal Adapter" to the same inventor of this application includes a plurality of plugs slidably held in a casing having different-shaped plug pins adapted to be plugged in different sockets of multiple nations in the world for a convenient universal electrical connection.

However, this universal adapter has the following drawbacks:

1. All the plugs are slidably mounted in a recess (121) recessed in a rear portion of the casing. Whenever using a specific plug, the user's fingers should be deeply inserted into the recess (121) in order to protrude the plug forwardly beyond the front cover (11), causing inconvenience for the user.

2. After protruding the plug pins, the locking member (16) should be vertically slid to stop the extended plug pins, increasing the operating steps for using the adapter.

3. When withdrawing the round plug pins (211) from an extended position, the two wedge snap members (214) should be squeezed for retracting the snap members (214) and the plug (21) rearwardly to be received in the casing. To squeeze the snap members (214) within a narrow space between the two extended plug pins (211) will be very difficult and inconvenient.

The present inventor has improved the drawbacks of the inventor's previous U.S. Pat. No. 5,159,545 and invented this easily operable universal adapter.

SUMMARY OF THE INVENTION

The object of the present invention is to provide a universal adapter including: a casing combinable with a front cover and a rear cover having a pair of outlet sockets formed in the rear cover to output power, a first plug having a pair of rectangular-shaped pins slidably held in an upper chamber in the casing and operatively pushed or pulled by a pair of first seesaw buttons pivotally secured on two opposite sides of the first plug for a convenient extending or retraction of the first plug, whereby upon extending of the first plug, a rectangular-shaped pin of "grounding pin" will be simultaneously biased for its forward extending to form triple rectangular-shaped pins for connecting municipal power such as in British or African areas to be output through the pair of outlet sockets in the rear cover; a second plug having a pair of flat blades slidably held in a lower chamber in the casing and operatively pushed or pulled by a pair of second seesaw buttons for a convenient extension or retraction for connecting municipal power to the two outlet sockets; and a third plug having a pair of round pins pivotally mounted on the front cover to be horizontally extended for power connection use and vertically received into the front cover when not in use.

BRIEF DESCRIPTION OF THE DRAWINGS

FIG. 3 is a cross sectional view of the present invention when viewed from 3—3 direction of FIG. 2.

FIG. 5 is a cross sectional drawing showing the extension of the first plug of the present invention.

FIG. 6 is a partial side view of the seesaw button located at a middle position of the guiding groove of the casing.

FIG. 7 shows a stopping button as moved from FIG. 6.

FIG. 8 is a cross sectional view of the present invention when viewed from 8—8 direction of FIG. 2.

DETAILED DESCRIPTION

Figure 1:
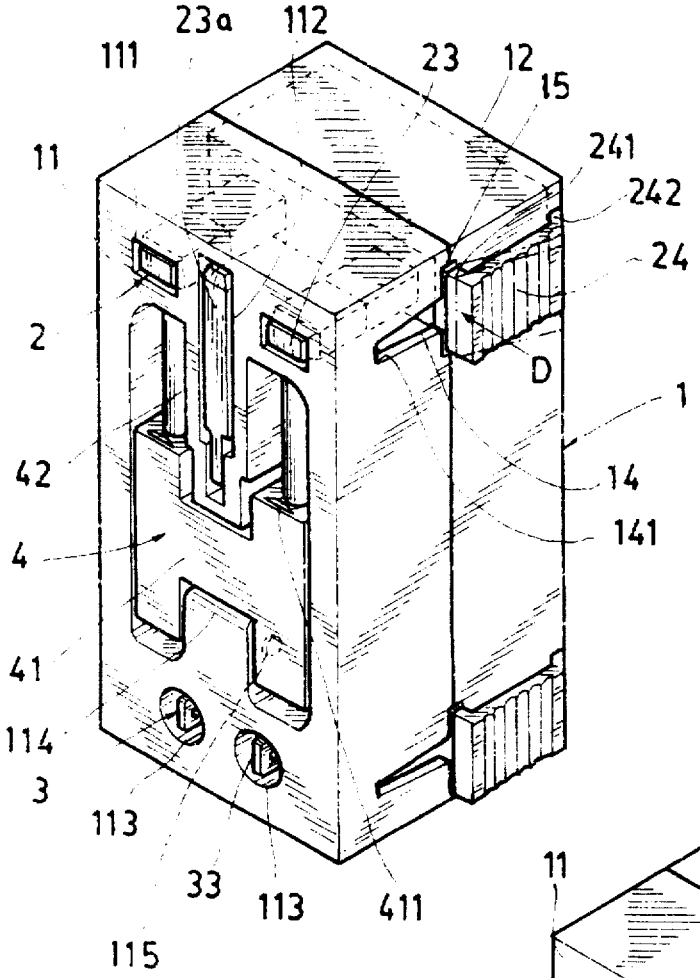
FIG. 1 is a perspective view of the present invention with the plug pins retracted in the casing.

As shown in the drawing figures, a preferred embodiment of the universal adapter of the present invention comprises: a casing 1 combinable with a front cover 11 and a rear cover 12, a first plug 2 slidably held in an upper chamber 13 in the casing 1, a second plug 3 slidably held in a lower chamber 16 of the casing 1, a third plug 4 pivotally mounted on a front cover 11 of the casing 1, a pair of electrically conductive plates 5 juxtapositionally secured in an internal retaining portion 19 between the front and rear covers 11, 12 of the casing 1; and a pair of outlet sockets 6 corresponding to two output receptacles 55 of the two conductive plats 5 for outputing power transmitted from the plugs 2, 3, 4.

The casing 1; the bases 21, 31, 41 for connecting the pins; and the buttons 24, 34 are made of electrically insulative materials. The locations, arrangements and shapes of the elements of the present invention may be modified and not limited in this invention. Even though there is not provided any transformer in this invention such as for converting an input 220 volts to an output 110 volts, the transformer may also be incorporated in this invention as modified.

Figure 4:
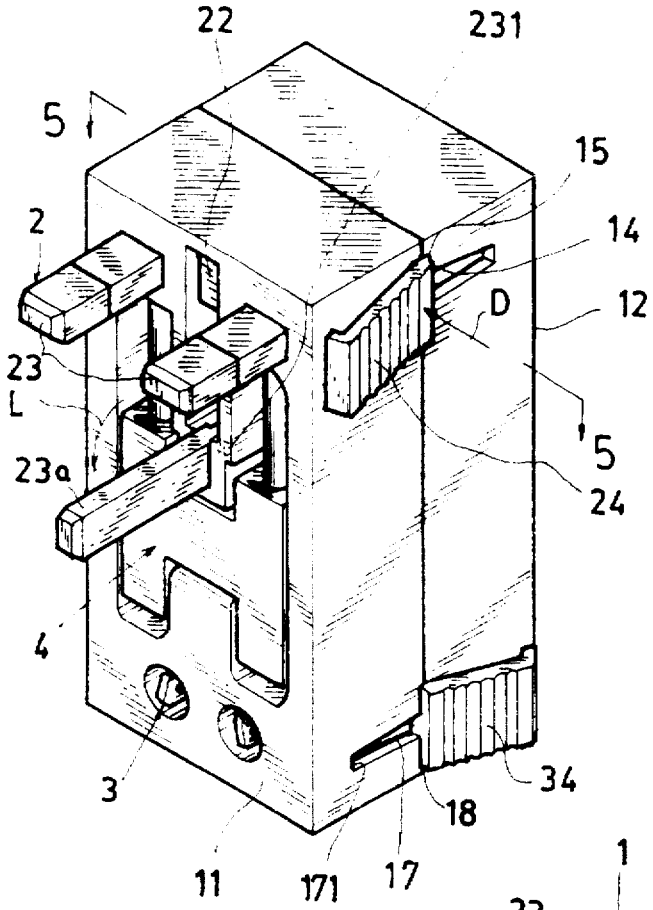
FIG. 4 is an illustration showing an extension of the first plug according to the present invention.

The first plug 2 includes: a first plug base 21 slidably held in an upper chamber 13 in the casing 1; a pair of rectangular-shaped plug pins 23 protruding forwardly from a shoulder portion 22 formed on a front portion of the first plug base 21; a pair of first seesaw buttons 24 disposed on two opposite sides of the first plug base 21 each first seesaw button 24 pivotally secured to the first plug base 21 by a first pivoting device 25 which may be a pivot secured to the base 21 and a pivot holder secured to the button 24, but not limited in this invention; and a pair of first contactors 26 electrically connected with the two rectangular-shaped plug pins 23 and respectively formed on a rear portion of the first plug base 21 to be slidably contacted with the pair of electrically conductive plats 5, 5, whereby upon a forward pushing of the first plug base 21 by pushing the pair of first seesaw buttons 24, the pair of rectangular-shaped plug pins 23 can be extended forwardly through a pair of first pin holes 111 formed in the front cover 11 of the casing 1 in cooperation with a grounding pin 23*a* pivotally mounted in a pin recess 112 recessed in the front cover 11 by a pivot 231 and operatively biased by the shoulder portion 22 when forwardly pushing the first plug base 21 to be gravitationally horizontally extended (L) to form triple rectangular-shaped pins 23, 23*a* as shown in FIGS. 3–5 for connecting a municipal power such as in England, Africa, etc.

Each first seesaw button 24 as pivotally connected with the first plug base 21 by a first pivoting device 25 has a front lug 241 and a rear lug 242 respectively disposed on two ends of the first seesaw button and bent inwardly towards the casing 1, with the first pivoting device 25 slidably held in a first guiding groove 14 horizontally cut through an upper side portion of the casing 1 for guiding a forward or a rearward sliding movement of the first pivoting device 25 in the first guiding groove 14 and for reciprocating the first plug base 21 in the upper chamber 13 for extending or retracting the rectangular-shaped plug pins 23.

A first vertical slot 15 is vertically formed in a middle portion of the first guiding groove 14 to communicate with the first guiding groove 14 for engaging a front lug 241 of the first seesaw button 24 when inwardly depressed (D) when the first plug 2 is retracted (R) in the casing 1 as shown in FIGS. 1, 3; or for engaging a rear lug 242 of the first seesaw button 24 when depressed (D) and when the first plug 2 is extended (P) as shown in FIGS. 4, 5.

The first guiding groove 14 has a width equal to a height of the first pivoting device 25 and is tapered forwardly to form a front tapered end portion 141 and also tapered rearwardly to form a rear tapered end portion 142 for stably frictionally holding the first pivoting device 25 when stopped at a front end or rear end of the first guiding groove 14 as shown in FIGS. 6, 7.

Upon disengagement of the front lug 241 of the first seesaw button 24, the first seesaw button 24 can be pushed (P) forwardly to extend the plug pins 23 forwardly to bias the grounding pin 23*a* downwardly. After pushing the first plug 2 to the front position of the casing 1, the rear lug 242 can be inwardly depressed (D) to engage the vertical slot 15 for locking the first plug 2 for its stable power connection.

For withdrawing the first plug 2 into the casing 1, the seesaw button 24 is unlocked and retracted rearwardly (R) until stopped at the rear end of the guiding groove 14 and the front lug 241 can be depressed to engage the vertical slot 15 as shown in FIG. 3 for retracting the pair of rectangular-shaped pins 23. The grounding pin 23*a* can be vertically received into the recess 112 in the front cover. The grounding pin 23*a* is an auxiliary pin in cooperation with the two rectangular-shaped pins 23 in order to be plugged into the triple sockets as used in England. Since the outlet sockets 6 are provided only for two poles output connection, the grounding pin 23*a* is not made electrically conductive in this invention.

Figure 11:
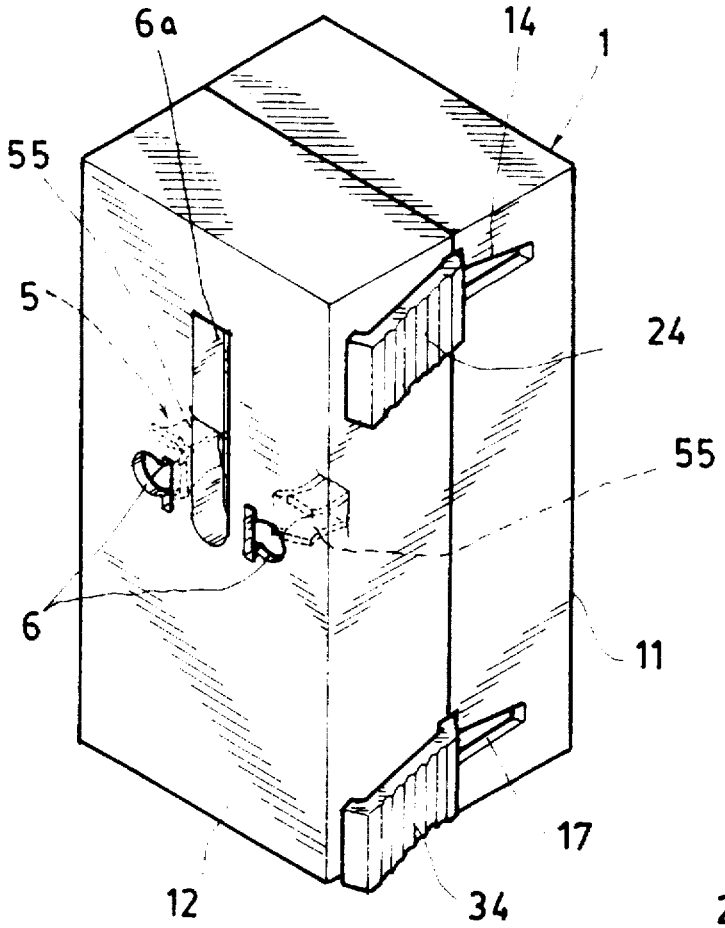
FIG. 11 is a rear view of the present invention.
Figure 2:
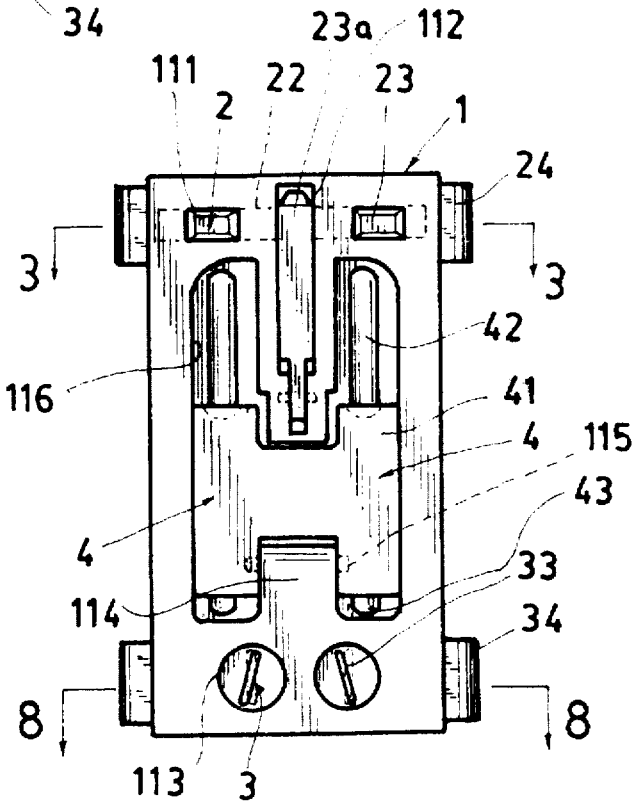
FIG. 2 is a front view of the present invention.

The pair of outlet sockets 6 are formed through the rear cover 12 of the casing 1 to be corresponding to a pair of output receptacles 55 formed on the two electrically conductive plates 5 juxtapositionally secured, embedded or adhered in the interior of the casing 1 for connecting an external plug having a pair of round pins or flat blades of an electrical appliance such as a mini iron, a coffee heater or other electrical equipments which are carried for uses when travelling around the world. If the plug has three pins including a grounding pin, the grounding pin may be inserted into the recess 6*a* recessed in the rear cover 12 while the other two pins inserted in the two sockets 6 (FIG. 11).

Figure 10:
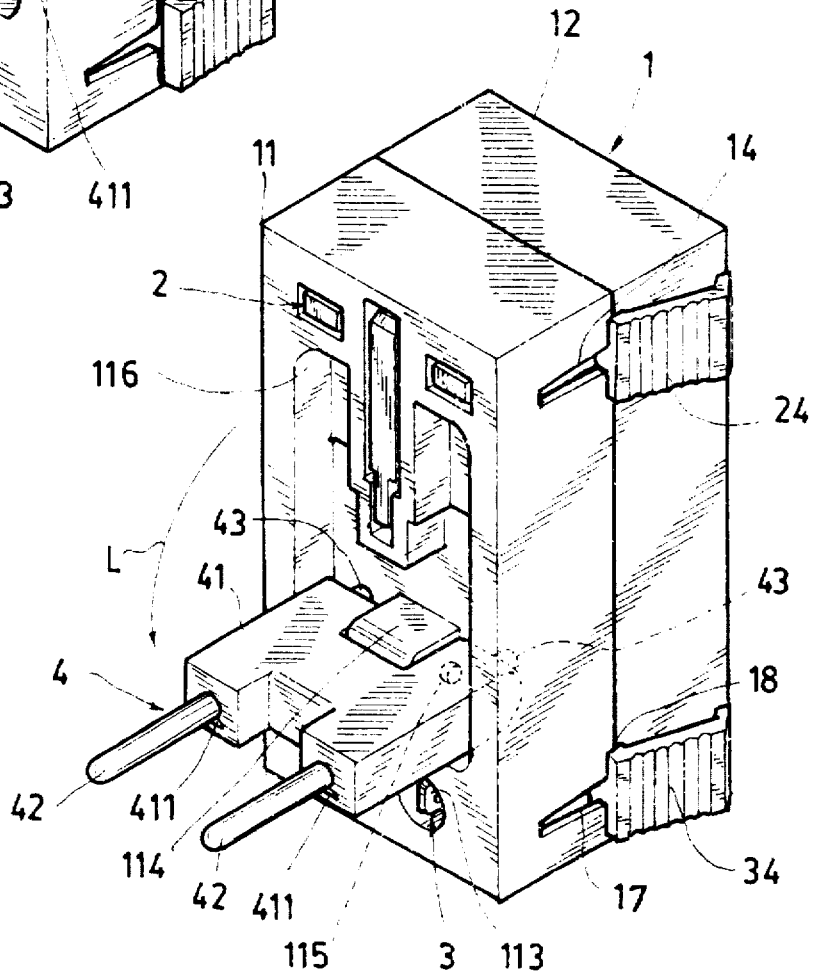
FIG. 10 shows an extension of the third plug of the present invention.
Figure 9:
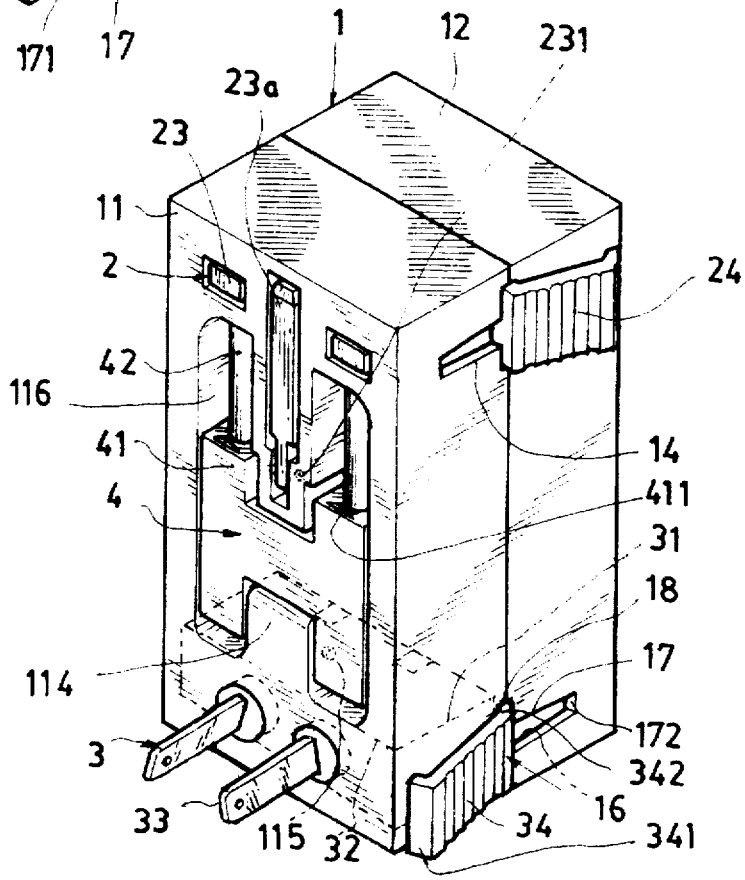
FIG. 9 is an illustration showing the extension of a second plug of the present invention.

The second plug 3 as shown in FIGS. 8–10 includes: a second plug base 31 slidably held in a lower chamber 16 in the casing 1; a pair of flat blades 33 protruding forwardly from a front portion 32 of the second plug base 31; a pair of second seesaw buttons 34 disposed on two opposite sides of the second plug base 31 each second seesaw button 34 pivotally secured to the second plug base 31 by a second pivoting device 35 which may be a pivot secured to the base 31 and a pivot holder secured to the button 34, but not limited in this invention; and a pair of second contactors 36 electrically connected with the two flat blades 33 and respectively formed on a rear portion of the second plug base 31 to be slidably contacted with the pair of electrically conductive plats 5, 5, whereby upon a forward pushing of the second plug base 31 by pushing the pair of second seesaw buttons 34, the pair of flat blades 33 can be extended forwardly through a pair of second pin holes 113 formed in the front cover 11 of the casing 1 for connecting a municipal power such as in USA, Taiwan, etc. Each flat blade 33 may be rotated to a desired angle.

Each second seesaw button 34 as pivotally connected with the second plug base 31 by a second pivoting device 35 has a front lug 341 and a rear lug 342 respectively disposed on two ends of the seesaw button and bent inwardly towards the casing 1, with the second pivoting device 35 slidably held in a second guiding groove 17 horizontally cut through a lower side portion of the casing 1 for guiding a forward or a rearward sliding movement of the second pivoting device 35 in the guiding groove 17 and for reciprocating the plug base 31 in the lower chamber 16 for extending or retracting the flat blades 33.

A second vertical slot 18 is vertically formed in a middle portion of the second guiding groove 17 to communicate with the second guiding groove 17 for engaging a front lug 341 of the second seesaw button 34 when inwardly depressed (D) when the second plug 3 is retracted (R) in the casing 1; or for engaging a rear lug 342 of the seesaw button 34 when depressed (D) and when the plug 3 is forwardly extended (P).

The second guiding groove 17 has a width equal to a height of the second pivoting device 35 and is tapered forwardly to form a front tapered end portion 171 and also tapered rearwardly to form a rear tapered end portion 172 for stably frictionally holding the second pivoting device 35 when stopped at a front end or rear end of the second guiding groove 17.

The third plug 4 as shown in FIGS. 10, 1 includes: a third plug base 41 pivotally mounted on a holding portion 114 formed on the front cover 11 by a pivot 115, a pair of round pins 42 protruding from the third plug base 41, and a pair of rear pin portions 43 each connected with each round pin 42 to be electrically connected with two electrically conductive plates 5 for outputing power as input from the two round pins 42 when connected to a municipal power as provided in Europe and middle east areas, with the third plug 4 normally received in a H-shaped recess 116 recessed in the front cover 11.

The third plug base 41 is recessed with at least a snap notch 411 for an easy biasing of the round pins 42 downwardly to be horizontally extended for power connection.

Figure 12:
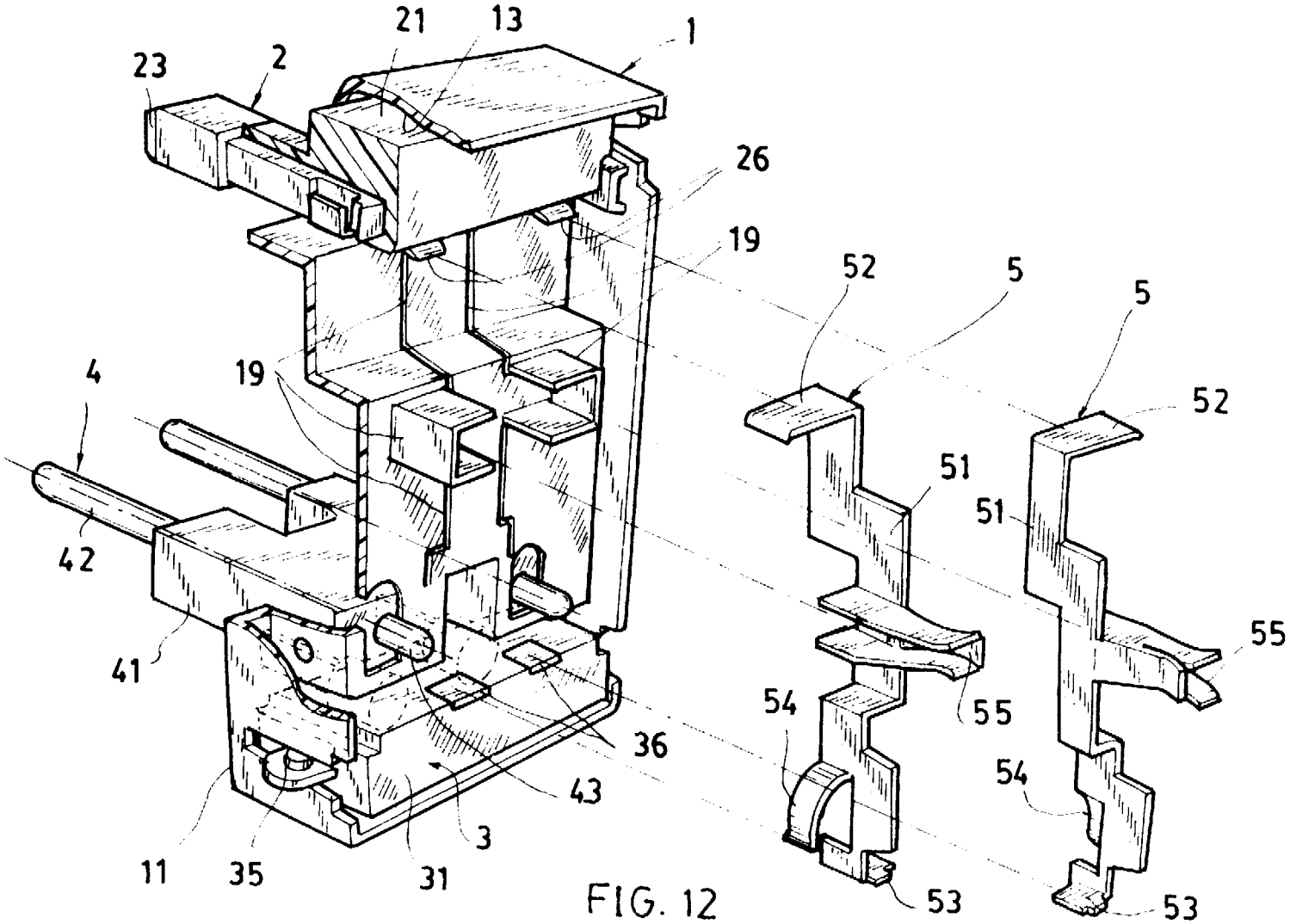
FIG. 12 is an exploded view of the present invention showing the electrically conductive plates.
Figure 13:
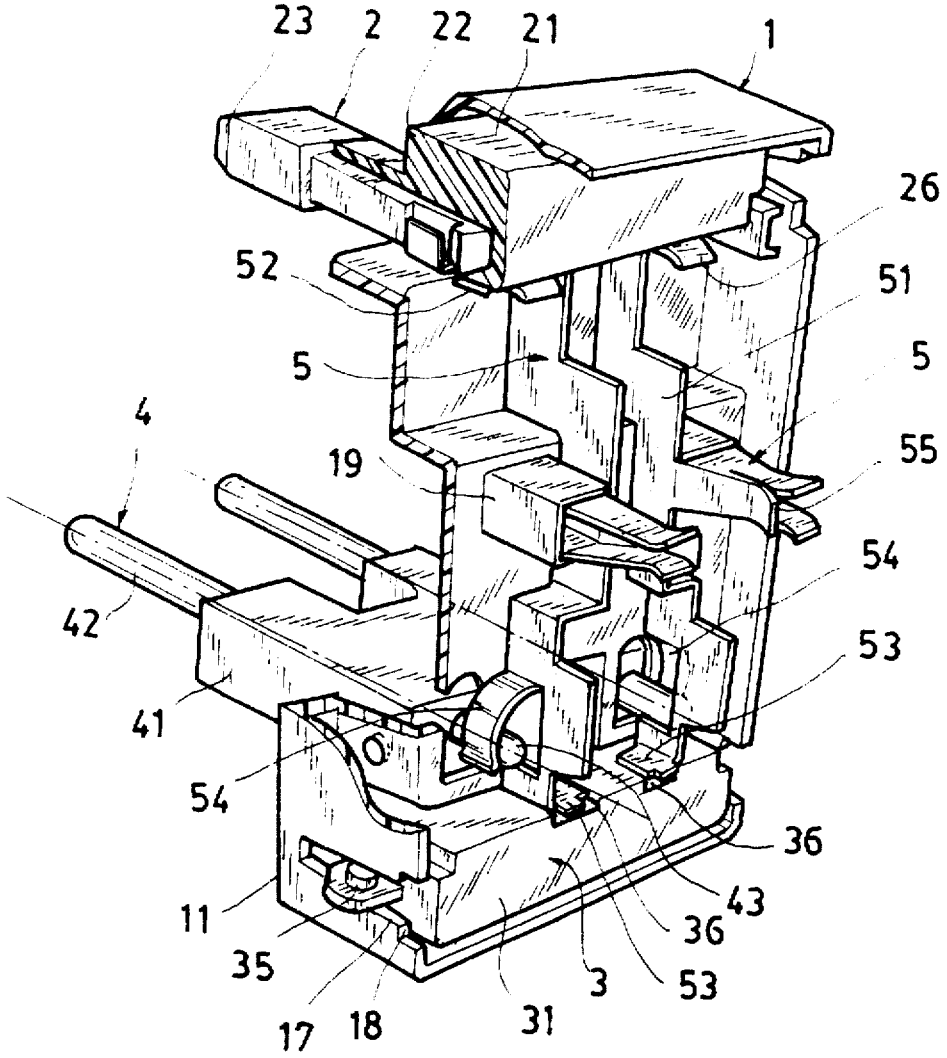
FIG. 13 is a perspective view of the present invention when assembled from FIG. 12.

Each electrically conductive plate 5 as shown in FIGS. 12, 13 includes: an elongated strip 51 such as made of copper fixed in an interior in the casing 1, an upper edge portion 52 formed on an upper end of the elongated strip 51 to be slidably contacted with each first contactor 26 of the first plug 2, a lower edge portion 53 formed on a lower end of the elongated strip 51 to be slidably contacted with the second contactor 36 of the second plug 3, a clip 54 branched from the elongated strip 5 for clamping a rear pin portion 43 of each round pin 43 of the third plug 4 when downwardly biased for horizontally extending the round pins 43 for power connection, and an output receptacle 55 protruding rearwardly from the elongated strip 51 to be corresponding to each outlet socket 6 formed in the rear cover 12 of the casing 1 for connecting an external plug pin from an electric appliance insertable into the outlet socket 6.

The present invention is superior to the U.S. Pat. No. 5,159,545 because an easier forward pushing and rearward retraction of the first and second plugs 2, 3 can be manipulated just by depressing and moving the seesaw buttons 24, 34. After moving the buttons to a front or rear end of the guiding groove 14, 17, the seesaw buttons 24, 34 may also be directly depressed to be locked on the casing 1 for a stable and convenient locking of the plugs 2, 3. The plug 4 of round pins may also be conveniently operated just by pivoting the plug base 41 either horizontally or vertically.

The present invention may be modified without departing from the scope and spirit of the present invention.

I claim:

1. A universal adapter comprising:

a casing;

a first plug having a grounding rectangular-shaped pin pivotally mounted in a front portion of said casing, and including: a first plug base slidably held in an upper chamber formed in the casing; a pair of rectangular-shaped plug pins protruding forwardly from a shoulder portion formed on a front portion of the first plug base; a pair of first seesaw buttons disposed on opposite sides of the first plug base each first seesaw button pivotally secured to the first plug base by a first pivoting device; and a pair of first contactors electrically connected with the two rectangular-shaped plug pins and respectively formed on a rear portion of the first plug base to be slidably contacted with the pair of electrically conductive plats, whereby upon a forward pushing of the first plug base by pushing the pair of first seesaw buttons, the pair of rectangular-shaped plug pins are extended forwardly through a pair of first pin holes formed in the front cover of the casing in cooperation with said grounding rectangular-shaped pin which is pivotally mounted in a pin recess recessed in the front cover by a pivot and operatively biased by the shoulder portion of said first plug base when forwardly pushing the first plug base to be gravitationally horizontally extended to form triple rectangular-shaped pins for connecting the first minicipal power;

a second plug having a pair of flat blades formed on said second plug slidably held in a second portion of said casing and reciprocatively moved in said casing by at least a second button slidably held in said casing, said flat blades on said second plug operatively extended beyond the front portion of said casing for connecting a second municipal power;

a third plug having a third plug base pivotally mounted on a front portion of said casing, a pair of round pins secured on said third plug base and operatively extended pivotally horizontally beyond the front portion of said casing for connecting a third municipal power;

a pair of electrically conductive plates juxtapositionally secured in an interior in said casing for respectively electrically connecting two poles of said first, second and third plugs for inputing each municipal power; and a pair of outlet sockets formed in a rear portion of said casing for corresponding to two output receptacles formed on said pair of electrically conductive plate for outputing a two-pole power as input from said plugs.

2. A universal adapter according to claim 1, wherein said second plug includes: a second plug base slidably held in a lower chamber in the casing; a pair of flat blades protruding forwardly from a front portion of the second plug base; a pair of second seesaw buttons disposed on opposite sides of the second plug base, each second seesaw button pivotally secured to the second plug base by a second pivoting device; and a pair of second contactors electrically connected with the two flat blades and respectively formed on a rear portion of the second plug base to be slidably contacted with the pair of electrically conductive plats, whereby upon a forward pushing of the second plug base by pushing the pair of second seesaw buttons, the pair of flat blades are extended forwardly through a pair of second pin holes formed in the front cover of the casing.

3. A universal adapter according to claim 2, wherein each said seesaw button as pivotally connected with the plug base by said pivoting device has a front lug and a rear lug respectively disposed on two ends of the seesaw button and bent inwardly towards the casing, with the pivoting device slidably held in a guiding groove horizontally cut through a side portion of the casing for guiding a forward or a rear sliding movement of the pivoting device in the guiding groove and for reciprocating the plug base in a chamber of the casing for extending or retracting the blades in the casing.

4. A universal adapter according to claim 3, wherein said casing is formed with a vertical slot vertically formed in a middle portion of the guiding groove to communicate with the guiding groove for engaging the front lug of the seesaw button inwardly depressed when the plug is retracted in the casing; or for engaging a rear lug of the seesaw button when inwardly depressed and when the plug is extended.

5. A universal adapter according to claim 3, wherein said guiding groove has a width equal to a height of the pivoting device and is tapered forwardly to form a front tapered end portion and tapered rearwardly to form a rear tapered end portion on said guiding groove for stably frictionally holding the pivoting device when stopped at a front end or a rear end of the guiding groove.

6. A universal adapter according to claim 1, wherein said third plug base is recessed with at least a snap notch therein for an easy biasing of the round pins downwardly to be horizontally extended for power connection.

7. A universal adapter according to claim 1, wherein each said electrically conductive plate includes: an elongated strip fixed in an interior in the casing, an upper edge portion formed on an upper end of the elongated strip to be slidably contacted with a first contactor of the first plug, a lower edge portion formed on a lower end of the elongated strip to be slidably contacted with a second contactor of the second plug, a clip branched from the elongated strip for clamping a rear pin portion of each said round pin of the third plug when downwardly biased for horizontally extending the round pins for power connection, and one said output receptacle protruding rearwardly from the elongated strip to be corresponding to each said outlet socket formed in a rear cover of the casing for connecting an external plug pin from an electric appliance insertable into the outlet socket.

* * * * *